US012637182B2

(12) United States Patent
Blakeney

(10) Patent No.: US 12,637,182 B2
(45) Date of Patent: May 26, 2026

(54) PERSONAL WATERCRAFT ATTACHMENT SYSTEM

(71) Applicant: Solo Brands, LLC, Grapevine, TX (US)

(72) Inventor: Jimmy Blakeney, Wakefield, RI (US)

(73) Assignee: SOLO BRANDS, LLC, Grapevine, TX (US)

( * ) Notice: Subject to any disclaimer, the term of this patent is extended or adjusted under 35 U.S.C. 154(b) by 522 days.

(21) Appl. No.: 18/119,438

(22) Filed: Mar. 9, 2023

(65) Prior Publication Data

US 2023/0286619 A1 Sep. 14, 2023

Related U.S. Application Data

(60) Provisional application No. 63/317,960, filed on Mar. 9, 2022.

(51) Int. Cl.
*B63B 32/40* (2020.01)
*B63B 32/77* (2020.01)

(52) U.S. Cl.
CPC ..... *B63B 32/40* (2020.02); *B63B 32/77* (2020.02)

(58) Field of Classification Search
CPC ..... B63B 32/00; B63B 32/40; B63B 32/77; B63B 17/00; B63B 17/02; B63B 7/00; B60J 11/04; B60J 11/00
USPC ..... 114/361, 364; 441/65
See application file for complete search history.

(56) References Cited

U.S. PATENT DOCUMENTS

| | | | |
|---|---|---|---|
| 5,070,807 | A | 12/1991 | Lewis |
| 6,129,034 | A | 10/2000 | Santa Cruz et al. |
| 2015/0210150 | A1 | 7/2015 | Alexander |

*Primary Examiner* — Lars A Olson
(74) *Attorney, Agent, or Firm* — David R. Yohannan; Yohannan Law

(57) ABSTRACT

A system for attaching items to a personal watercraft is disclosed. The system may include arrays of flexible fastener loop assemblies provided on opposing sides of the watercraft. G-Hook connectors and associated webbing straps may be connected to the flexible fastener loop assemblies.

21 Claims, 12 Drawing Sheets

PERSONAL WATERCRAFT ATTACHMENT SYSTEM

FIELD OF THE INVENTION

Embodiments of the present invention relate to systems for adjustable and removable attachment of accessories to a personal watercraft or portable dock.

BACKGROUND OF THE INVENTION

Portable, and frequently inflatable, personal watercraft, such as paddleboards, kayaks, and portable docks are currently in wide use. In order to be available for use by individuals with different physical attributes, currently available watercraft are of limited size and weight. Due to such size and weight constraints, there are limits on the inclusion of fasteners incorporated into the watercraft for attaching accessories to it.

However, users of personal watercraft often have a need to temporarily attach accessories, such as a seat and backrest, spare paddles or oars, backpacks, coolers, and the like to the watercraft for a safe and comfortable use or excursion. Further, users who travel in groups sometimes have a need to attach two or more watercraft together during rest periods. Due the foregoing considerations, and due to size differences between users and size differences between various accessories that users make take on excursions, there is a need for an adjustable and accommodating system for temporarily attaching items to personal watercraft or a portable dock. There is also a need for an attachment system that is sufficiently robust to withstand harsh conditions, while also being lightweight, uncomplicated and of uniform design to give the user optimum flexibility in choosing locations on the watercraft or dock for connection points.

While some means already exist for attaching items to personal watercraft, there is no system that does not use rigid fasteners, such as metal or hard plastic loops, permanently attached to the watercraft. Because existing watercraft fasteners utilize permanently affixed rigid fasteners, such systems also lack versatility in terms of fastener location on the watercraft. By avoiding the inclusion of numerous rigid fasteners on the deck or gunwales of a personal watercraft, the watercraft is more capable of being used for activities such as fishing, reentry from the water, or even yoga. A watercraft deck free of rigid fasteners also may prevent harmful interactions between the watercraft and a user, as well as keep the deck clear of tangling or otherwise interfering obstacles.

OBJECTS OF THE INVENTION

Accordingly, it is an object of some, but not necessarily all, embodiments of the present invention to provide an attachment system for personal watercraft and portable docks that is lightweight in that it does not require the permanent inclusion of a plurality of rigid fastener elements, yet is still tough enough to withstand harsh environmental conditions and heavy use.

It is also an object of some, but not necessarily all, embodiments of the present invention to provide an attachment system for personal watercraft and portable docks that provides for straightforward and quick adjustment of connection points, while at the same time providing a wide range of available connection points.

It is another object of some, but not necessarily all, embodiments of the present invention to provide an attachment system for personal watercraft and portable docks that is simple to use for users of all skill levels, ages, and sizes.

It is yet another object of some, but not necessarily all, embodiments of the present invention to provide an attachment system for personal watercraft and portable docks that avoids the need to include a plurality of permanently affixed rigid fasteners on the watercraft deck and gunwales where they may present a harmful or even dangerous presence.

It is another object of some, but not necessarily all, embodiments of the present invention to provide an attachment system for personal watercraft and portable docks that permits multiple watercraft and/or docks to be connected together quickly and safely.

SUMMARY OF EMBODIMENTS OF THE INVENTION

Responsive to the foregoing challenges, Applicant has developed an innovative personal watercraft attachment system that includes an array of webbing loops arranged at or near, and spaced evenly along, the watercraft gunwales, a plurality of G-Hook fasteners configured to removably attach to each of the individual webbing loops in the array, and webbing straps attached to or available for attachment to, the G-Hook fasteners.

Applicant has further developed an innovative watercraft, comprising: an outer surface including a top surface, a first side surface and a second side surface, wherein the first side surface and the second side surface are on opposing sides of the top surface, and wherein the top surface and the first side surface intersect at a first gunwale portion and the top surface and the second side surface intersect at a second gunwale portion; a first array of a plurality of flexible fastener loop assemblies provided at or near the top surface at or near the first gunwale portion; a second array of a plurality of flexible fastener loop assemblies provided at or near the top surface at or near the second gunwale portion; wherein each of the first and second arrays comprise: a plurality of flexible fastener loops; a plurality of backing material patches to which corresponding ones of the plurality of flexible fastener loops is affixed at a back end; and an elongated strip of material sized to extend the length of the first or second array, said elongated strip of material having an array of slit openings, wherein the plurality of backing material patches are provided between the watercraft outer surface and the elongated strip of material, wherein a front looped end of each of the plurality of flexible fastener loops extends through a corresponding one of the slits in the array of slit openings and the back end of each of the plurality of flexible fastener loops is sandwiched between the elongated strip of material and corresponding ones of the plurality of backing material patches, and wherein the elongated strip of material is affixed to the outer surface at or near the top surface at or near the first gunwale portion or the second gunwale portion.

Applicant has still further developed an innovative watercraft, comprising: an inner bottom surface, a bow end, a stern end, a first inner side surface, and a second inner side surface; a first array of a plurality of flexible fastener loop assemblies provided along the first inner side surface along a first reference line extending between the bow end and the stern end; a second array of a plurality of flexible fastener loop assemblies provided along the second inner side surface along a second reference line extending between the bow end and the stern end; wherein each of the first and second arrays comprise: a plurality of flexible fastener loops; a plurality of backing material patches to which a back end of a corresponding one of each of the plurality of flexible fastener loops is affixed; and a plurality of elongated strips of material sized to cover a corresponding one of the plurality of backing material patches, each said elongated strip of material having first and second slit openings, wherein the plurality of backing material patches is provided between the first or second inner side surface and the elongated strip of material, wherein first and second front looped ends of each of the plurality of flexible fastener loops extend through corresponding first and second slits in a corresponding one of the plurality of elongated strips of material and the back end of each of the plurality of flexible fastener loops is sandwiched between the corresponding one of the plurality of elongated strips of material and a corresponding one of the plurality of backing material patches, and wherein each pair of corresponding ones of the plurality of the elongated strips of material and the plurality of backing material patches are affixed to the first or second inner side surfaces.

Applicant has yet further developed an innovative system for attaching items to a personal watercraft or a portable dock having an outer surface and opposing sides, said system comprising: first and second arrays of a plurality of flexible fastener loops provided on the opposing sides of the personal watercraft or portable dock outer surface; a plurality of G-Hook connectors configured to be securely received and connected to corresponding ones of the plurality of flexible fasteners loops; and a plurality of webbing straps configured to be connected to one or more of the plurality of G-Hook connectors, wherein each one of the plurality of flexible fastener loops includes backing material to which each of the plurality of flexible fastener loops is affixed at a back end; and an elongated strip of material sized to extend the length of the first or second array, said elongated strip of material having an array of slit openings, wherein the backing material is provided between the personal watercraft or portable dock outer surface and the elongated strip of material, wherein the front looped end of each of the plurality of flexible fastener loops extends through a corresponding one of the slits in the array of slit openings and the back end of each of the plurality of flexible fastener loops is sandwiched between the elongated strip of material and the backing material, and wherein the elongated strip of material and backing material are affixed to the outer surface.

It is to be understood that both the foregoing general description and the following detailed description are exemplary and explanatory only and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only and should not be construed as limiting the invention.

DETAILED DESCRIPTION OF EMBODIMENTS OF THE INVENTION

Figures 1, 2, 3:
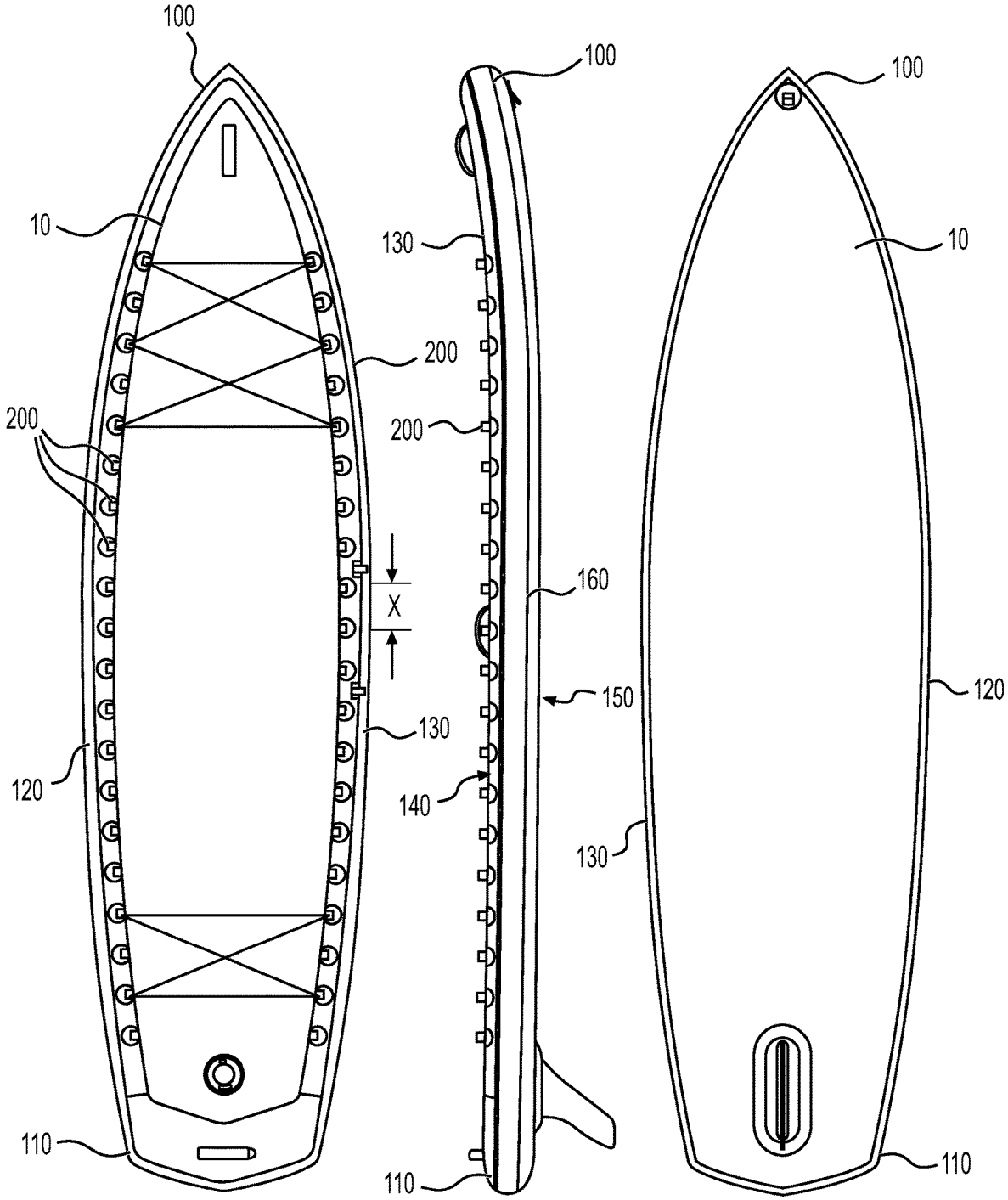
FIG. 1 is a top view of a paddleboard watercraft having a flexible fastener attachment system constructed in accordance with embodiments of the invention.
FIG. 2 is a side view of a paddleboard watercraft having an attachment system constructed in accordance with embodiments of the invention.
FIG. 3 is a bottom view of a paddleboard watercraft having an attachment system constructed in accordance with embodiments of the invention.

Reference will now be made in detail to embodiments of the present invention, examples of which are illustrated in the accompanying drawings. With reference to FIGS. 1-8, inclusive, embodiments of the invention may be provided as part of an inflatable paddleboard watercraft 10. The paddleboard 10 may include a bow 100 and a stern 110 provided at opposite ends of a watercraft having a port gunwale or gunnel portion 120 and a starboard gunwale or gunnel portion 130. The outer surface of the watercraft may include an upper deck or top surface 140 and a bottom surface 150 that may be bound by the watercraft 10 bow 100, stern 110, and gunwale portions 120 and 130. The gunwale portions 120 and 130 may have a gently curved portion at an upper edge that transitions from a relatively vertical side wall to the relatively horizontal upper deck 140.

A generally linear or curved array of a plurality of flexible fastener loop assemblies 200, preferably between ten (10) and thirty (30) flexible fastener loop assemblies per side, may be provided at or near the watercraft deck 140 along and at or near (within 1-2 inches) each of the port and starboard gunwale portions 120 and 130. Alternatively, the generally linear or curved arrays of flexible fastener loop assemblies 200 may be provided on the port gunwale portion 120 and the starboard gunwale portion 130. Preferably, each flexible fastener loop assembly 200 on a first side of the watercraft deck 140 is aligned directly across from a corresponding flexible fastener loop assembly on the other side of the watercraft.

Figure 4:
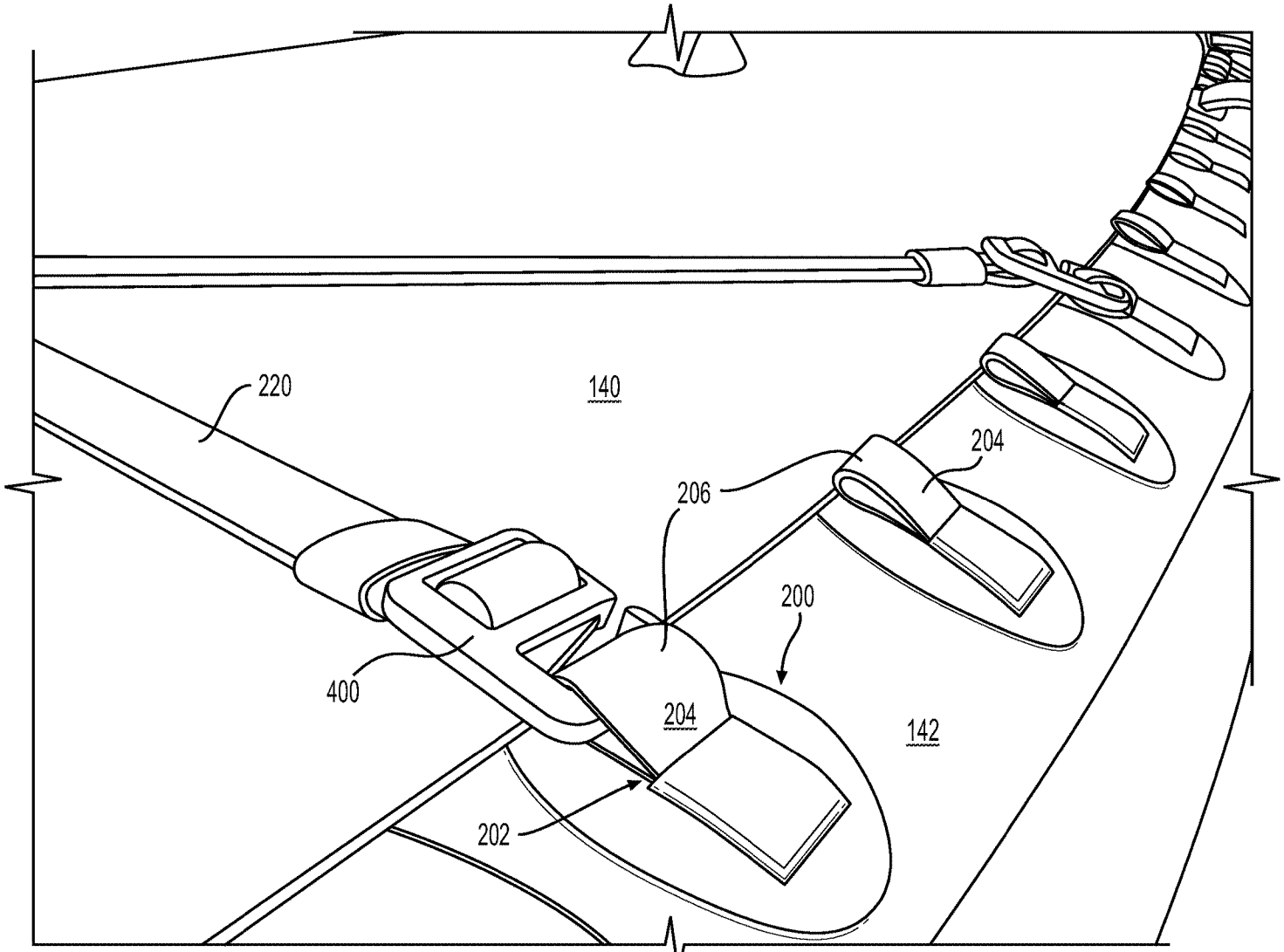
FIG. 4 is a detailed pictorial view of an individual webbing loop, G-Hook, and webbing strap that are part of a paddleboard watercraft having an attachment system constructed in accordance with embodiments of the invention.
Figure 15:
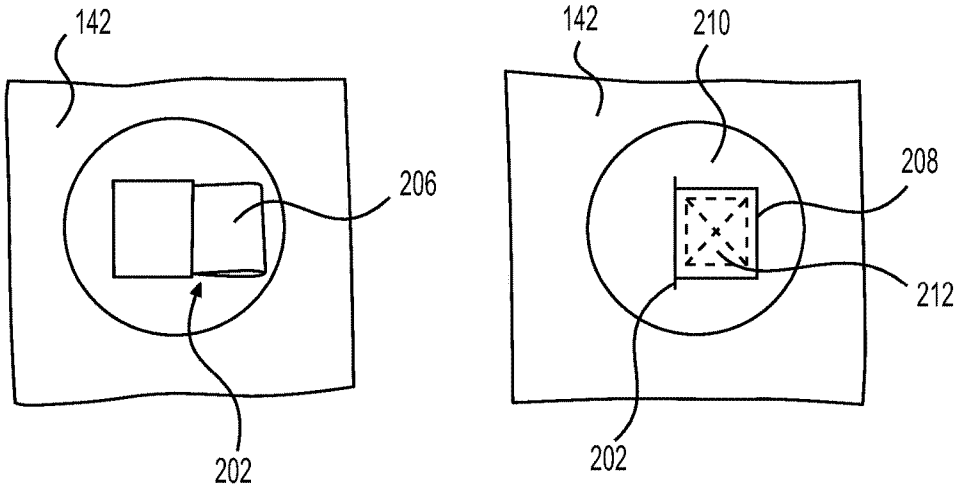
FIG. 15 is a top and bottom view of an individual webbing loop that is part of a paddleboard watercraft having an attachment system constructed in accordance with embodiments of the invention.
Figure 17:
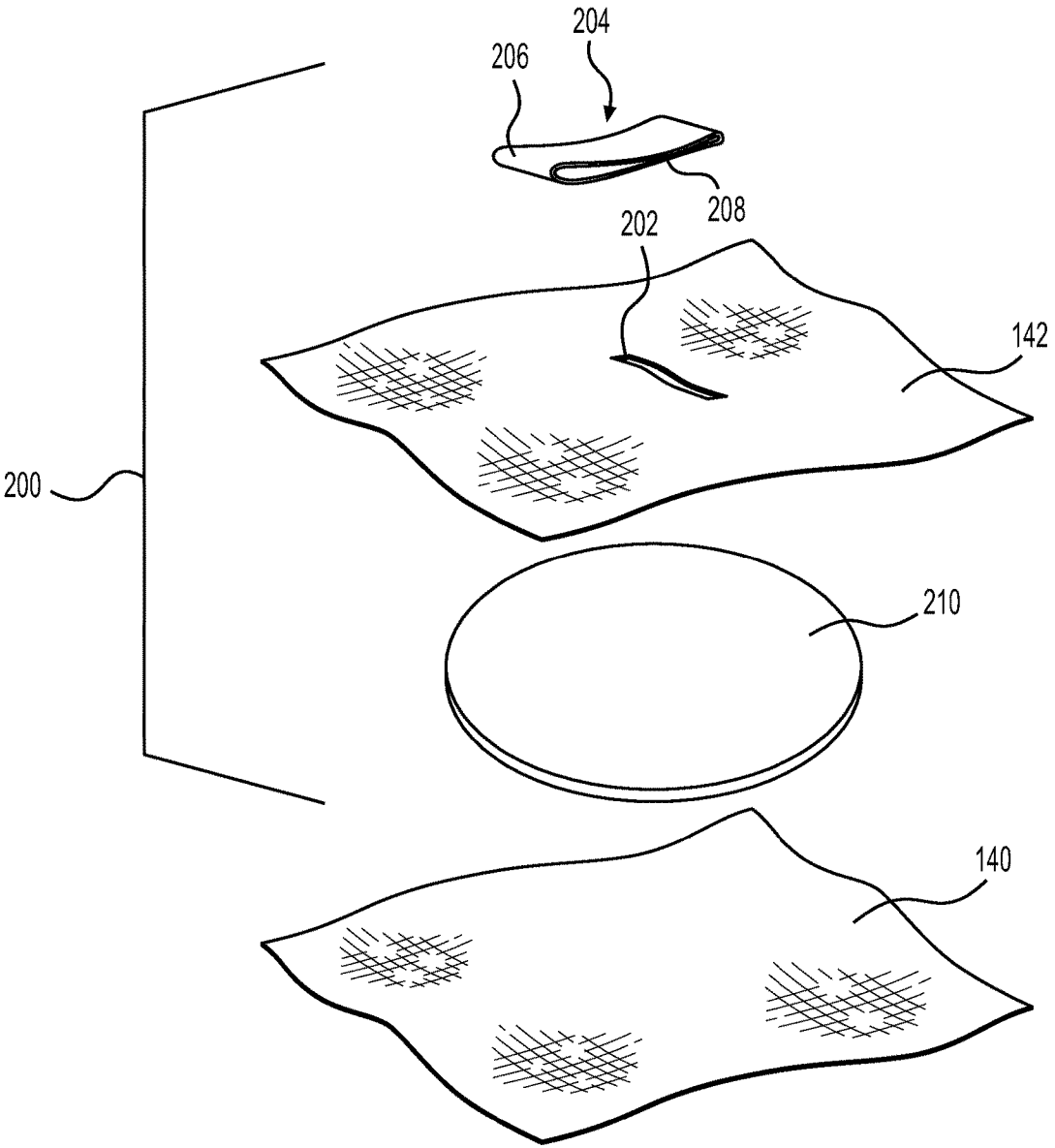
FIG. 17 is an exploded view of an individual webbing loop assembly that is part of a paddleboard watercraft having an attachment system constructed in accordance with embodiments of the invention.

With particular reference to FIGS. 4, 15 and 17, each flexible fastener loop assembly 200 may include a flexible fastener loop 204 having a front looped end 206 that protrudes through a slit 202 provided in an elongated strip of material 142 that is affixed to the deck 140. The elongated strip of material 142 has the advantage of not only being used to apply the flexible fastener loops 204, but also to add rigidity to the inflatable watercraft. A back end 208 (visible in the right side view of FIG. 15) of each flexible fastener loop 204 may be affixed, preferably using marine grade, heavy duty sowing thread 212 (shown as the "X" pattern in FIG. 15), to the backing material 210. Preferably, the backing material is comprised of individual patches of polyvinyl chloride (PVC) or thermoplastic polyurethane (TPU) provided for each of the flexible fastener loops 204. The elongated strip 142 is also preferably comprised of PVC or TPU material. The backing material patches 210 may be affixed, preferably using a PVC or TPU adhesive, to the underside of the elongated strip of material 142. In turn, the elongated strip of material may be affixed, preferably using a PVC adhesive, a TPU adhesive, and/or a heat and pressure welding technique, to the outer surface of the watercraft 10. With particular reference to FIG. 17, it is shown that each flexible fastener assembly 200 comprises a layered sandwich including a base layer of watercraft outer surface material, preferably the deck surface 140, a mid-layer patch of backing material 210 to which the back end 208 of the flexible fastener 204 is sewn, and an upper layer of elongated strip material 142 including a slit 202 through which a front loop end 206 of the flexible fastener extends. Adhesive, stitching, and/or heat and pressure welding may be used between each of the foregoing described base, mid, and upper layers of material to form a completed flexible fastener array 200.

The preferred method of providing an array of flexible fastener loop assemblies is as follows.

Step 1—Individual strips of flexible fastener material are cut and folded into loops 204. Individual pieces of backing material 210 are cut for each flexible fastener loop 204.

Step 2—The back ends 208 of individual flexible fastener loops 204 are sewn to PVC or TPU backing material 210 using marine grade, heavy duty thread 212.

Step 3—The elongated strip of PVC or TPU material 142 is cut to shape to match design of each particular watercraft 10 (i.e., curved to match shape of rails and intended location along rails).

Step 4—Slits 202 are cut into the elongated strip 142 at locations to receive the front looped ends 206 of the flexible fastener loops 204.

Step 5—The individual backing material patches 210 and flexible fastener loops 204 are glued to the bottom of the elongated strip 142 as the front looped ends 206 are pulled through the slits 202.

Step 6—The entire elongated strip 142 assembly is glued to the watercraft outer surface at the desired location.

The flexible fastener loops 204, which are preferably comprised of polyethylene webbing, may extend away from the watercraft gunwale portions 120 and 130 toward the interior of the watercraft deck 140 making them easier to work with from a user position on the deck. Polyethylene webbing may be utilized for the flexible fastener loops due to its rot-resistant, low stretch, strength, wear resistant, and availability in various colors, characteristics. The flexible fastener loops 204 are preferably all of like material and size, and placed at regular intervals (x) (see FIG. 1) of between two (2) to six (6) inches (center to center) at or near the gunwales 120 and 130. The system may incorporate some webbing loops 204 of different/distinct colors at certain points in each generally linear array of flexible fastener loops 200 in order to provide location information to a user for that particular webbing loop. For example, a mid-craft webbing loop 204 may be provided in red as opposed to yellow to quickly identify opposing mid-craft loop locations for a user.

Figure 5:
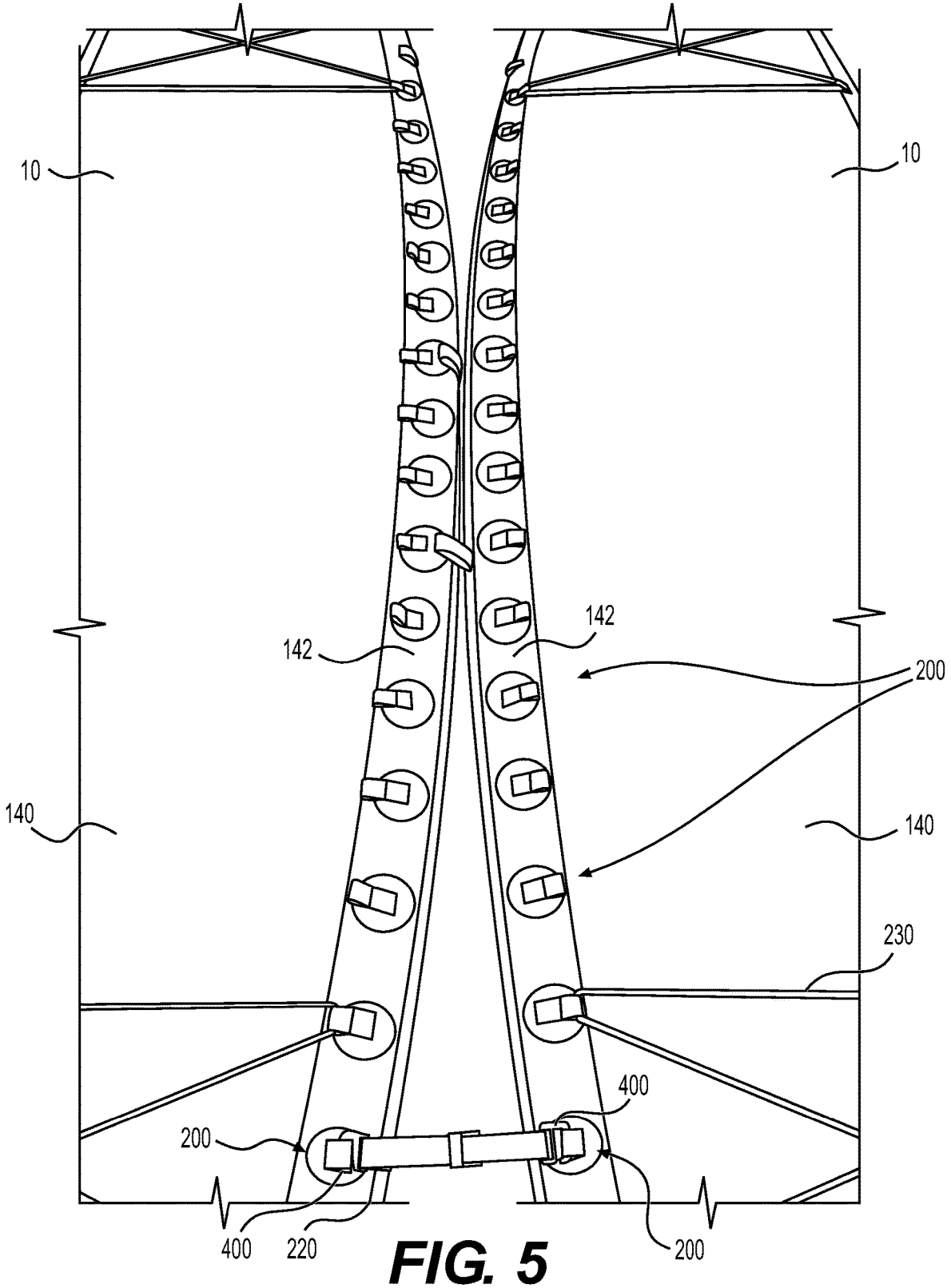
FIG. 5 is a pictorial view of two paddleboard watercraft connected together using an attachment system constructed in accordance with embodiments of the invention.
Figure 6:
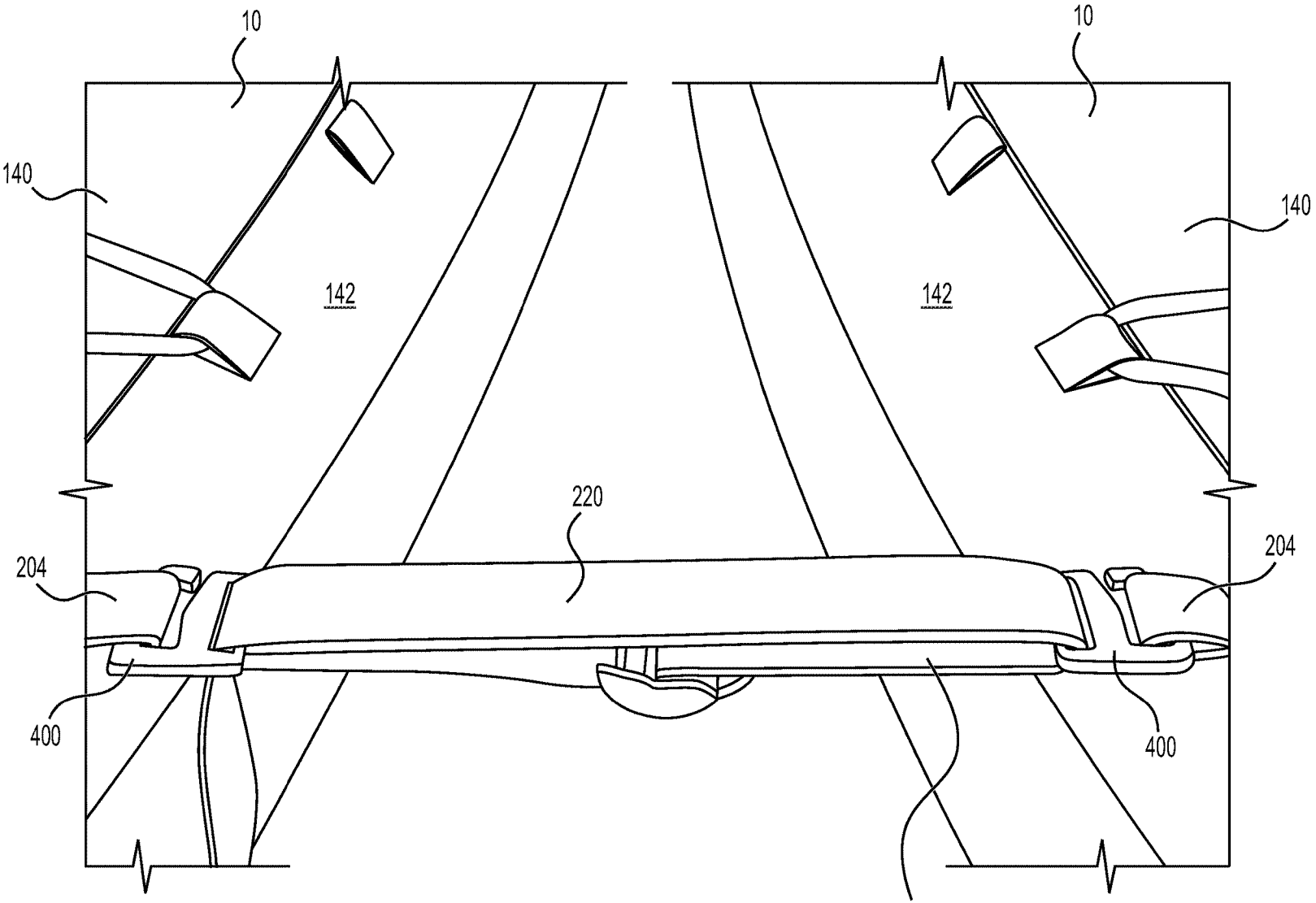
FIG. 6 is a detailed pictorial view of the bow connection point shown in FIG. 5 that utilizes an attachment system constructed in accordance with embodiments of the invention.
Figure 7:
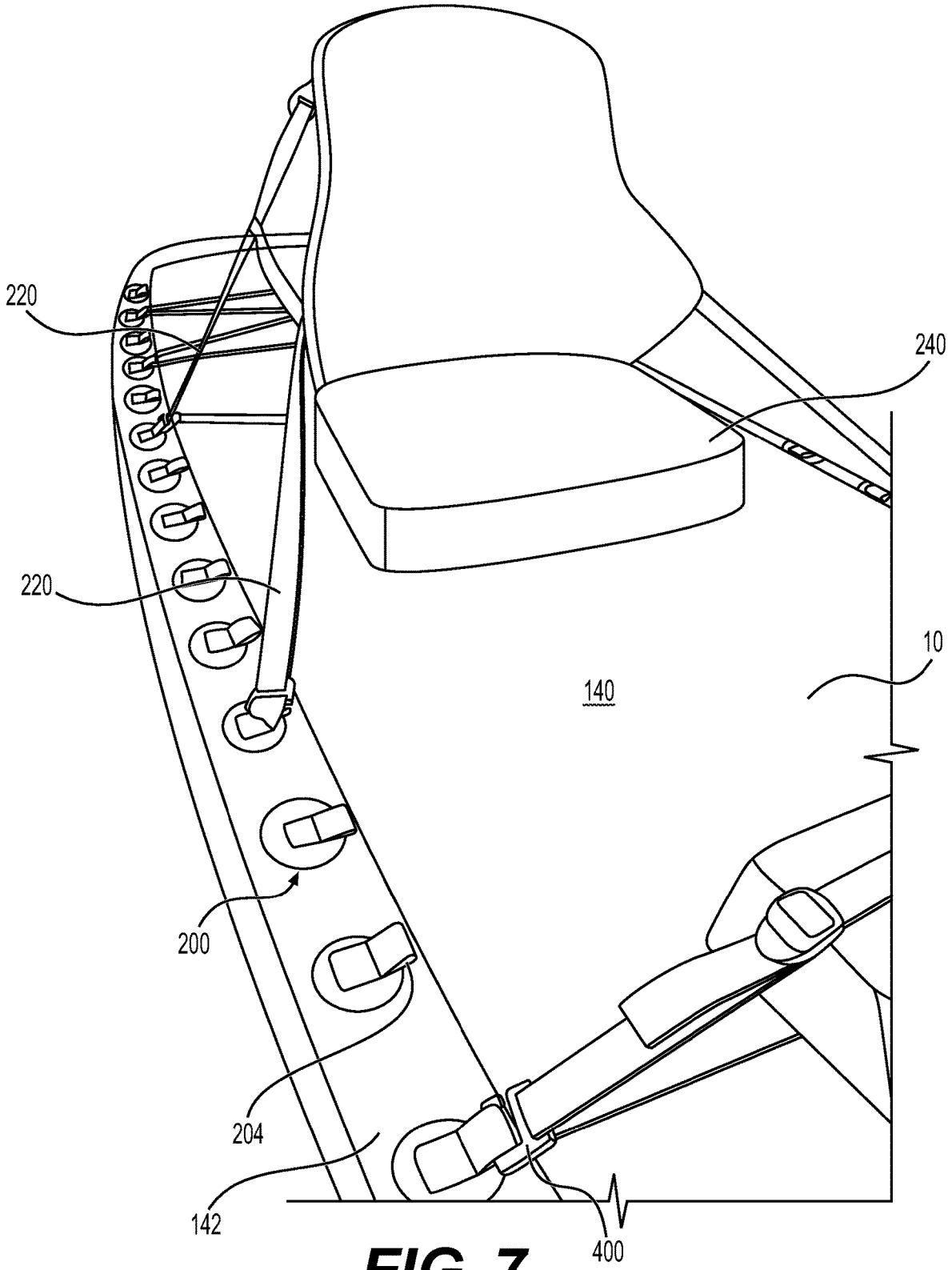
FIG. 7 is a pictorial view of a paddleboard watercraft outfitted with seat/floatation devices that are connected to the watercraft using an attachment system constructed in accordance with embodiments of the invention.
Figure 8:
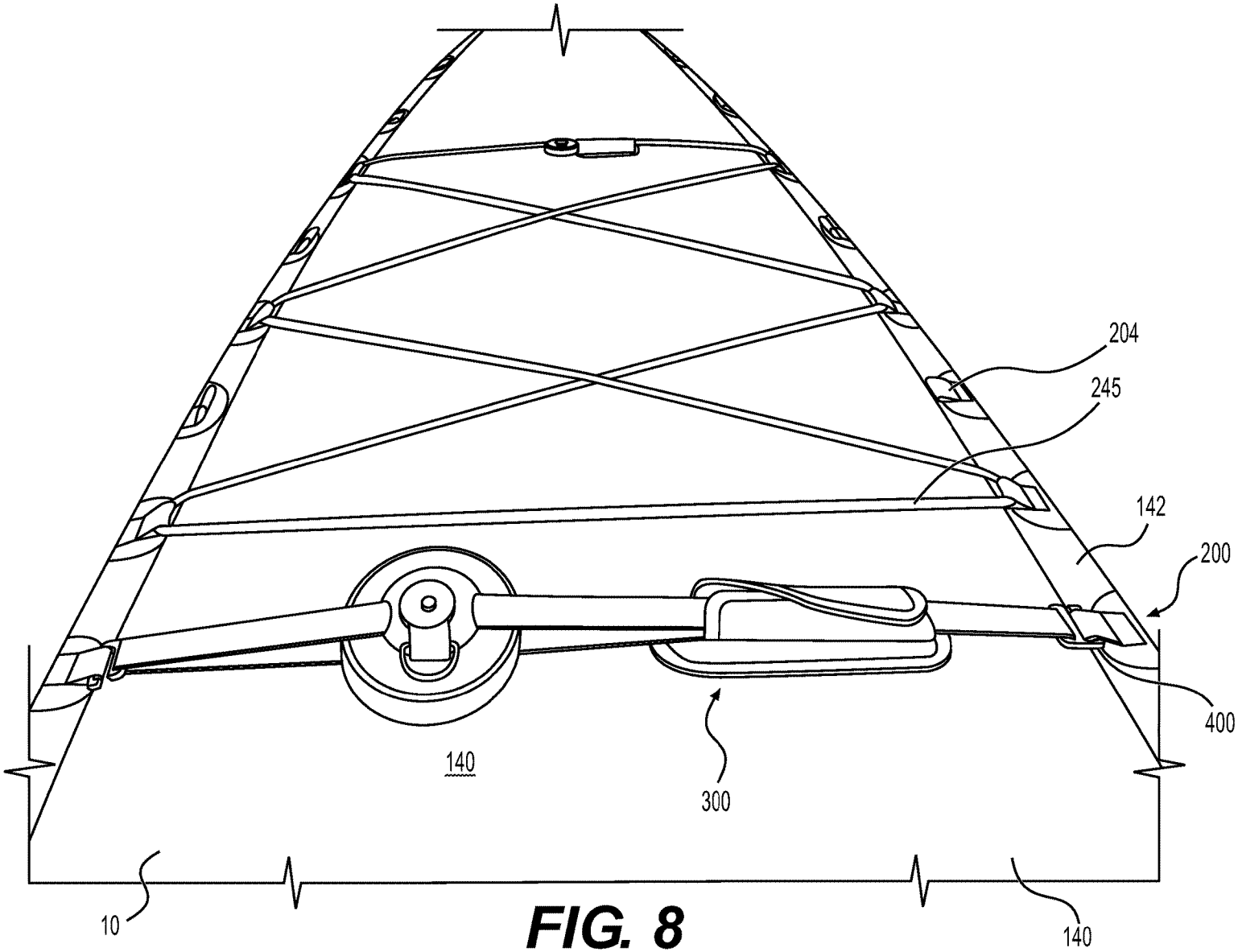
FIG. 8 is a detailed pictorial view of the bow portion of a paddleboard watercraft having a bungee cord and a dual G-Hook/webbing strap included in an attachment system constructed in accordance with embodiments of the invention.
Figure 14:
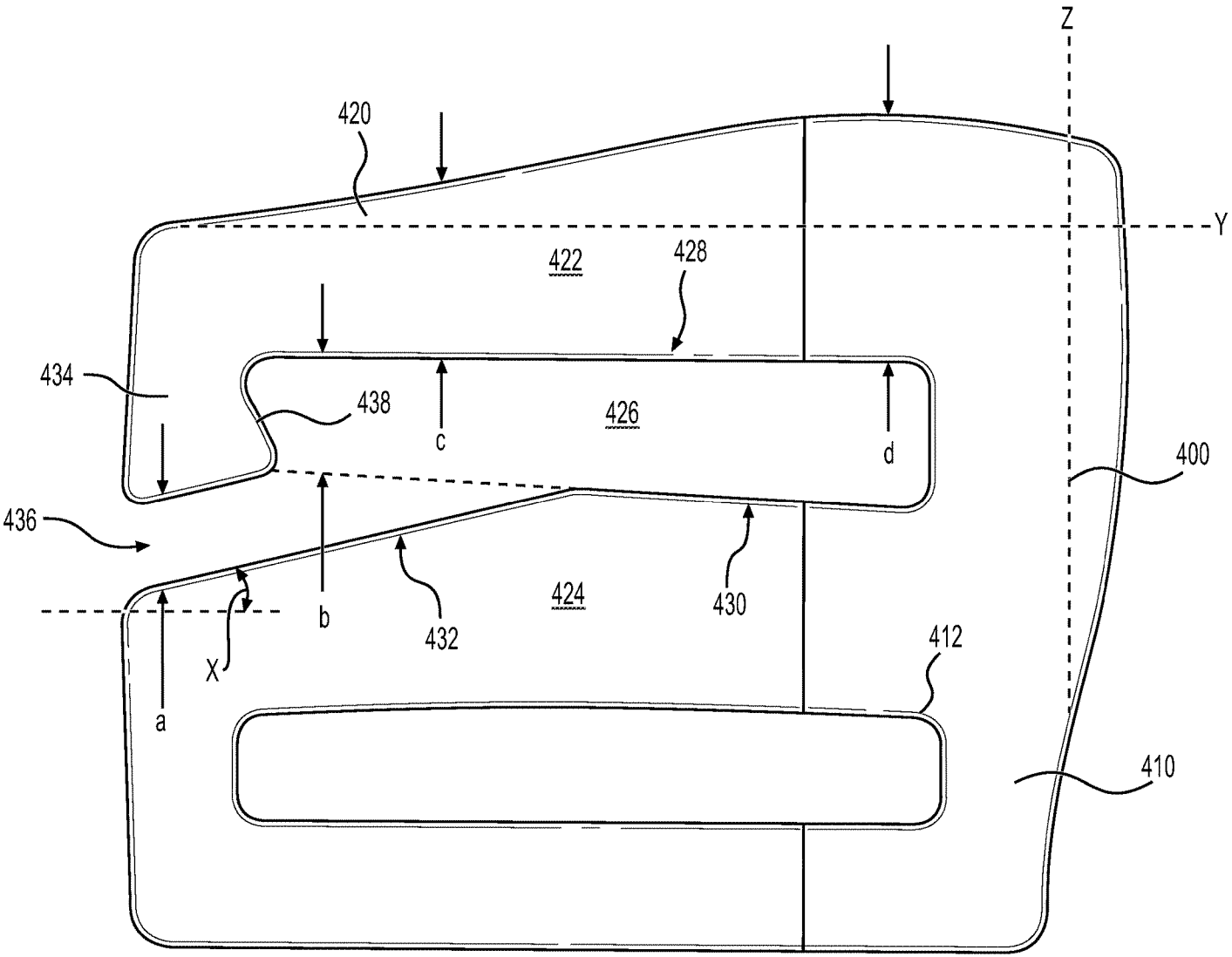
FIG. 14 is a top view of a preferred G-Hook used in an attachment system constructed in accordance with embodiments of the invention.

With renewed reference to FIGS. 4-8, and reference to FIG. 14, each flexible fastener loop 204, being of generally uniform construction, may be configured to removably attach to a G-Hook connector 400 that in turn is connected to a webbing or other type of strap 220. Each G-Hook connector 400 may preferably be constructed from metal or plastic, and more preferably from stainless steel. FIGS. 5 and 6 illustrate the use of an embodiment of the watercraft attachment system to temporarily connect two paddleboard watercraft 10 to each other using selected opposing ones of the flexible fastener loops 200 and webbing loops 204 to connect to two G-Hook/webbing strap assemblies 400/220. FIGS. 7 and 8 illustrate the use of an embodiment of the subject inventive system including the arrays of flexible loop fasteners 200 to removably connect a seat 240, bungee cord 245, and/or other items to the deck 140 of the watercraft 10 using webbing straps 220 and G-Hook fasteners 400.

Figure 9:
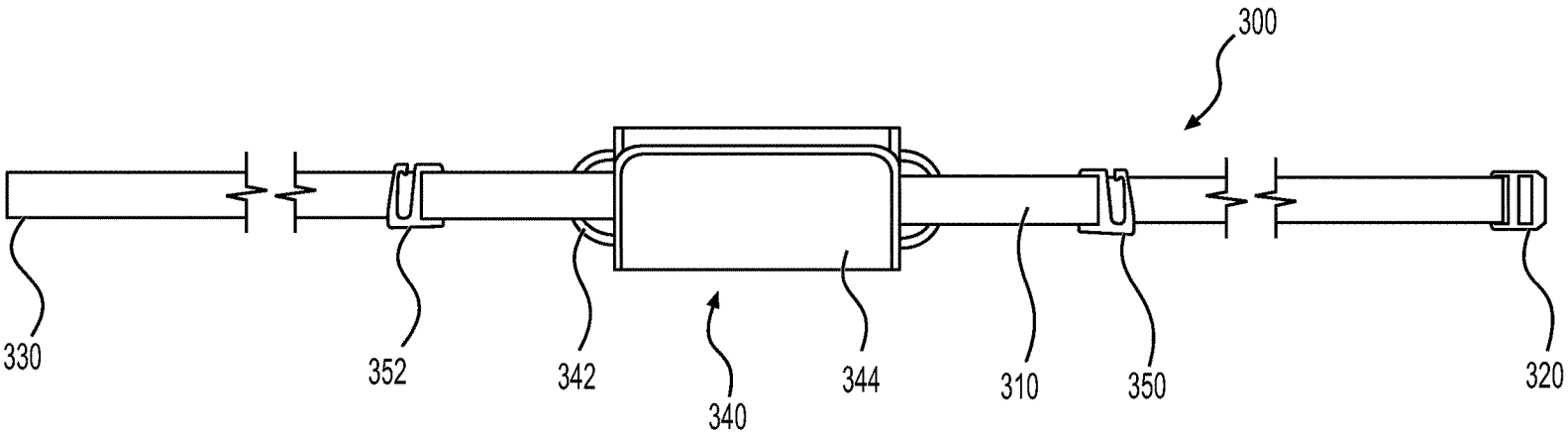
FIG. 9 is a top view of a versatile carry strap that may be included in an attachment system constructed in accordance with embodiments of the invention.
Figure 10:
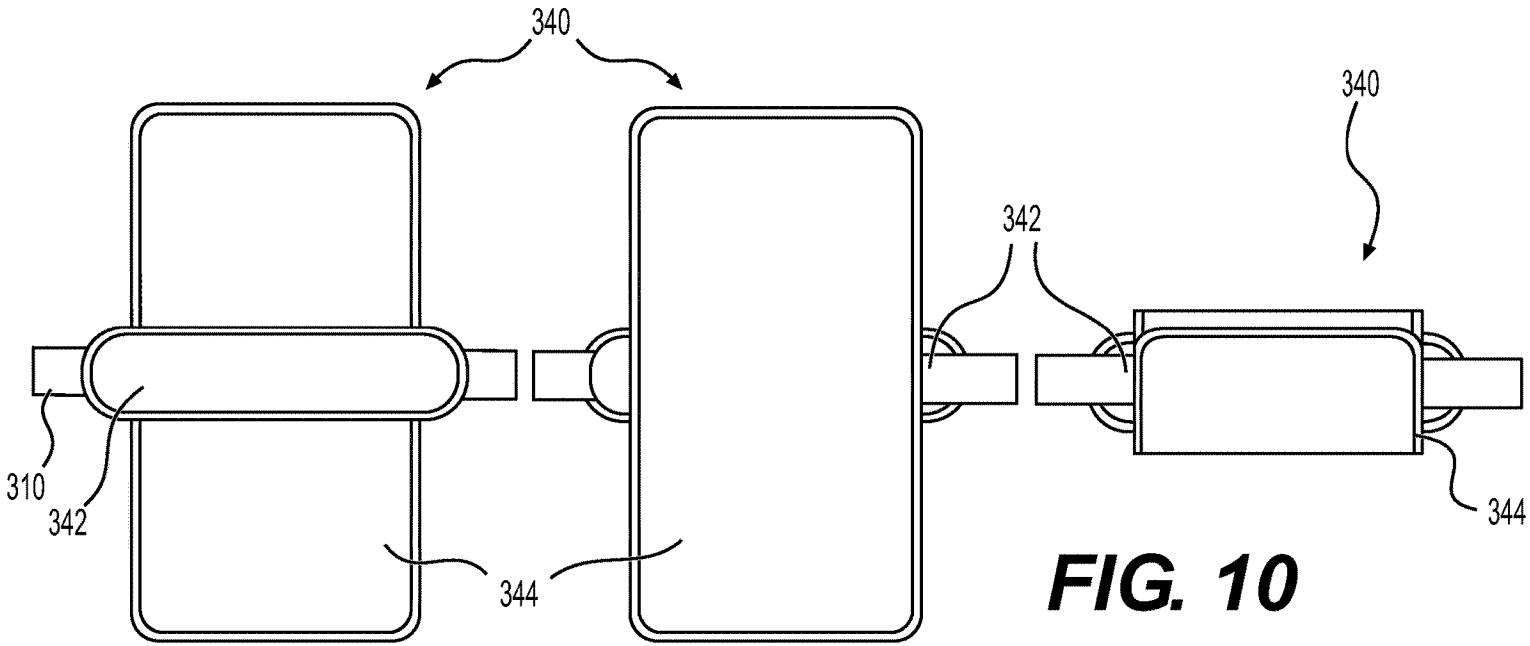
FIG. 10 are top views of the handle portion of the carry strap shown in FIG. 9 in open top, open bottom, and closed top positions.

With particular reference to FIGS. 8, 9 and 10, one or more embodiments of the inventive system preferably include a "Super Strap" or specialized strap 300 having a predetermined length and features. Each specialized strap 300 may include a length of strap material 310 (preferably webbing) having a buckle end 320 and a free end 330 which may be connected together to form a large loop of variable size. The center of the specialized strap 300 may include a handle portion 340 having Velcro flap 344 that may wrap around an enlarged width padded base 342 and close on itself. First and second G-Hook connectors 350 and 352 may be slidably provided on the strap material 310 on opposites sides of the handle portion 340.

A preferred G-Hook connector 400 is illustrated in FIG. 14. With continued reference to FIG. 14, the G-Hook connector 400 may be constructed of marine grade 316 stainless steel (or similar material). The G-Hook connector 400 may have a bottom portion 410 in which an opening 412 is formed to receive a loop of webbing (220 shown in FIG. 6). The upper portion of the G-Hook connector 400 may include an arm 422 having a primary lower surface 428 and an entry extension 434 defining a capture surface 438. The mid portion 424 of the G-Hook connector 400 may have a parallel upper surface 430 and an angled entry surface 432. A central slot 426 may be defined by the primary lower surface 426, the capture surface 438, the parallel surface 430, and the angled entry surface 432. The central slot 426 may be configured to receive and capture webbing material by means of the notch formed by the capture surface 438. The inward incline of the capture surface 438 is configured to secure webbing material snugly once it is fully inserted into the central slot 426.

Webbing may be introduced into the G-Hook connector 400 through an opening 436 having a width "a" which is configured to have a width that is just sufficient, but not more so, to receive webbing material. The width "a" of the opening 436 may be selected to be less than the width "b" of the central slot 426. The opening 436 may be defined by the angled entry surface 432 and a parallel surface provided on the entry extension 434. The angled entry surface 432 may be set at an angle "X" in the range of 10 to 30 degrees relative to a reference line parallel to the upper surface 430. The angled entry surface 432 may extend to about a mid-point of the central slot 426. The G-Hook connector 400 arm 422 may have a tapered shape such that the thickness of the arm increases gradually between points "c" and "d" to alleviate stress or failure points. In order to diminish stress points, the arm 422 has added material section 420 above reference line "Y" and to the right of reference line "Z." Preferably, the G-Hook connector 400 is configured to have a breaking strength of 100 kg or more.

Figure 11:
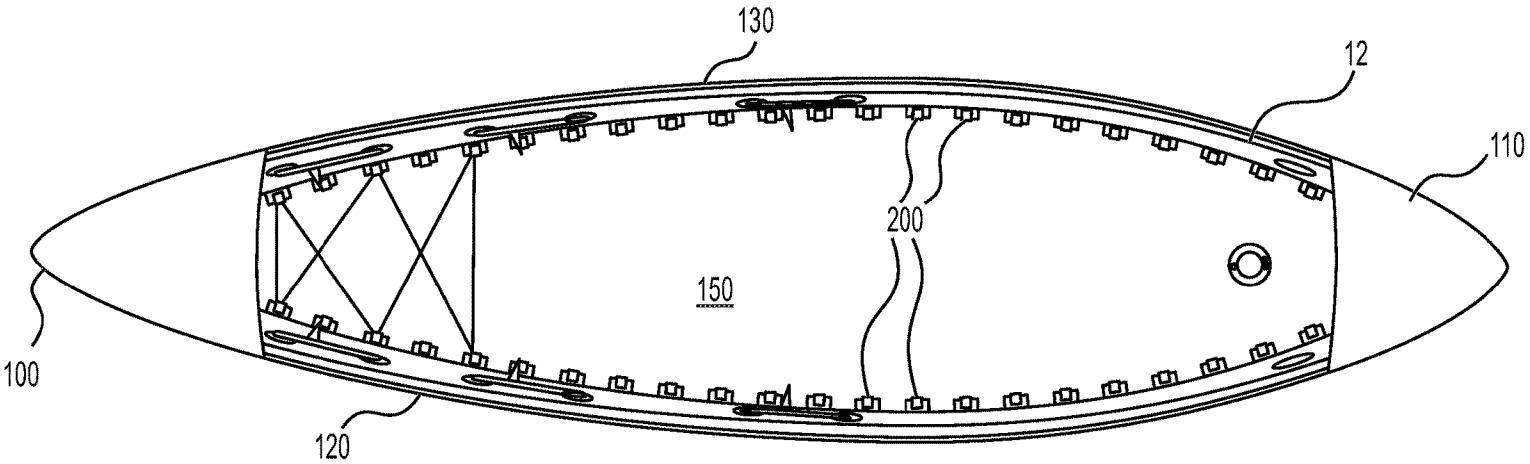
FIG. 11 is a top view of a kayak watercraft having an attachment system constructed in accordance with embodiments of the invention.
Figure 12:
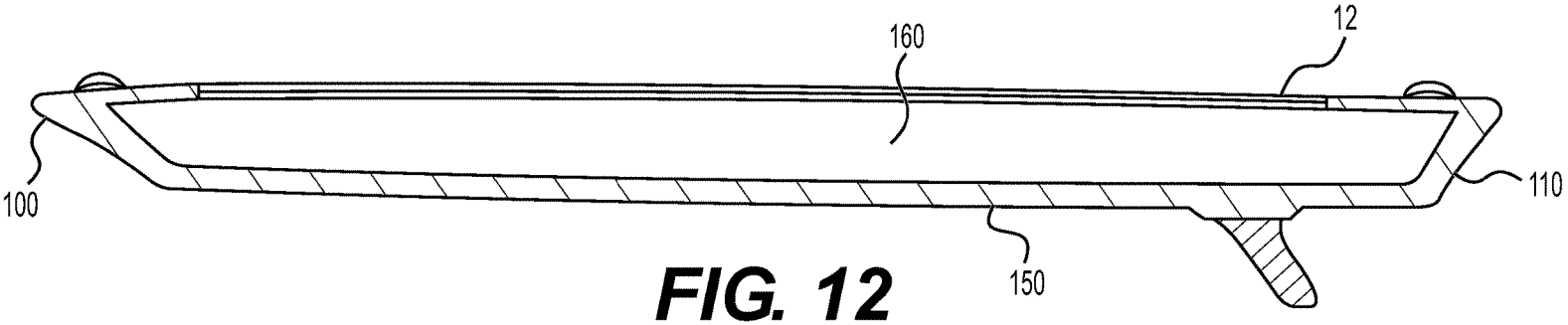
FIG. 12 is a cross-sectional side view of a kayak watercraft having an attachment system constructed in accordance with embodiments of the invention.
Figure 13:
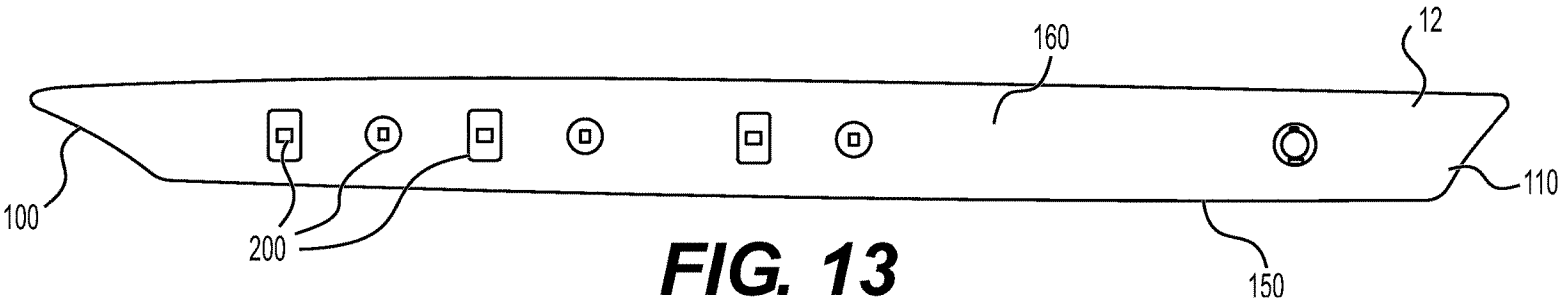
FIG. 13 is an internal side view of a paddleboard watercraft having an attachment system constructed in accordance with embodiments of the invention.
Figure 16:
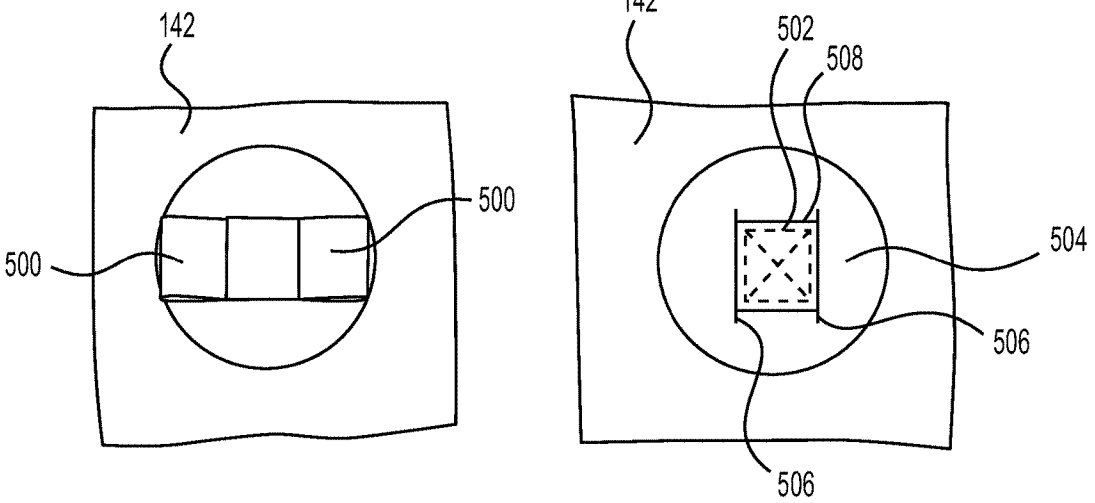
FIG. 16 is a top and bottom view of an individual webbing loop that is part of a kayak watercraft having an attachment system constructed in accordance with embodiments of the invention.

With reference to FIGS. 11-13, in which like reference characters indicate like elements, a kayak watercraft 12 embodiment of the present invention is illustrated having a system of flexible fastener loops 200 connected at regular intervals along the interior side hull 160 portions of the kayak. The kayak 12 may include a bow 100 and a stern 110 provided at opposite ends of a watercraft having a port sidewall 120, a starboard sidewall 130, and a bottom surface 150. The flexible fastener loops 200 may be constructed in a "butterfly" construction, as shown in FIG. 16. With reference to FIG. 16, each flexible fastener loop assembly 200 may include two flexible fastener loops having a front looped ends 500 that protrude through slits 506. A back end 508 (visible in the right side view of FIG. 16) of each flexible fastener loop may be affixed, preferably using marine grade, heavy duty sowing thread 502 (shown as the "X" pattern in FIG. 15), to the backing material 504. Preferably, the backing material 504 is comprised of individual patches of polyvinyl chloride (PVC) or thermoplastic polyurethane (TPU) provided for each of the flexible fastener loops. The elongated strip 142 is also preferably comprised of PVC or TPU material. The backing material patches 504 may be affixed, preferably using a PVC or TPU adhesive, to the underside of the elongated strip of material 142. In turn, the elongated strip of material 142 and the backing material 504 may be affixed, preferably using a PVC or TPU adhesive, to the inner surface of the kayak 12 sidewalls 120 and 130. Selected ones of the flexible fastener loops 200 may be identified for particular connection assignments using a code of color marking (not shown) or symbols (boxes and circles, shown).

Figure 18:
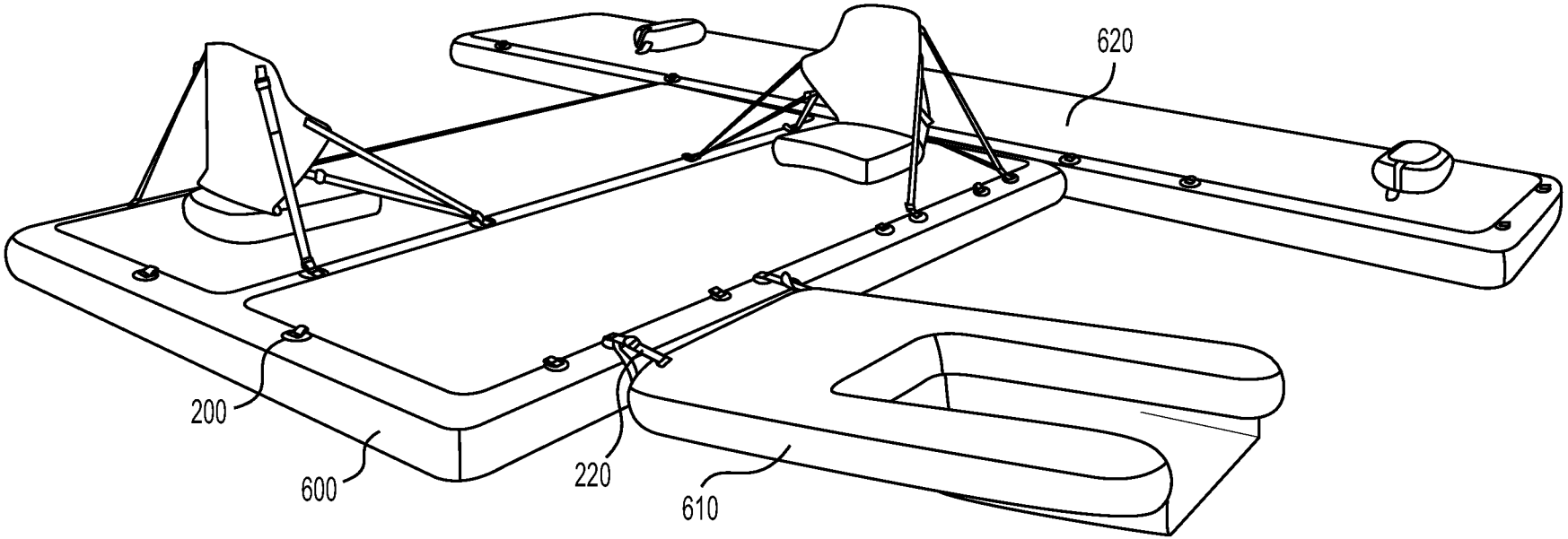
FIG. 18 is a pictorial view illustrating a dock system incorporating an attachment system constructed in accordance with embodiments of the invention.

FIG. 18 is a pictorial view illustrating a system of docks 600, 610 and 620 attached together using flexible fastener loops 200 and webbing 220.

As will be understood by those skilled in the art, the invention may be embodied in other specific forms without departing from the spirit or essential characteristics thereof. The elements described above are provided as illustrative examples for implementing the invention. One skilled in the art will recognize that many other implementations are possible without departing from the present invention as recited in the claims. For example, the shapes and sizes of various elements of the embodiments of the invention may be changed without departing from the intended scope of the invention. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed:

1. A watercraft, comprising:

an outer surface including a top surface, a first side surface and a second side surface, wherein the first side surface and the second side surface are on opposing sides of the top surface, and wherein the top surface and the first side surface intersect at a first gunwale portion and the top surface and the second side surface intersect at a second gunwale portion;

a first array of a plurality of flexible fastener loop assemblies provided at or near the top surface at or near the first gunwale portion;

a second array of a plurality of flexible fastener loop assemblies provided at or near the top surface at or near the second gunwale portion;

wherein each of the first and second arrays comprise:

a plurality of flexible fastener loops;

a plurality of backing material patches to which corresponding ones of the plurality of flexible fastener loops is affixed at a back end; and an elongated strip of material sized to extend the length of the first or second array, said elongated strip of material having an array of slit openings, wherein the plurality of backing material patches are provided between the watercraft outer surface and the elongated strip of material, wherein a front looped end of each of the plurality of flexible fastener loops extends through a corresponding one of the slits in the array of slit openings and the back end of each of the plurality of flexible fastener loops is sandwiched between the elongated strip of material and corresponding ones of the plurality of backing material patches, and wherein the elongated strip of material is affixed to the outer surface at or near the top surface at or near the first gunwale portion or the second gunwale portion.

2. The watercraft of claim 1 wherein each of the plurality of flexible fastener loops is affixed at the back end to the corresponding ones of the plurality of backing material patches by sewing threads.

3. The watercraft of claim 2 wherein the plurality of backing material patches are affixed to the elongated strip of material.

4. The watercraft of claim 3 wherein the plurality of backing material patches are affixed to the elongated strip of material using an adhesive.

5. The watercraft of claim 4 wherein the elongated strip of material is affixed to outer surface using an adhesive.

6. The watercraft of claim 5 wherein each of the plurality of flexible fastener loops is a webbing loop.

7. The watercraft of claim 6 wherein the plurality of backing material patches or the elongated strip of material are comprised of PVC or TPU.

8. The watercraft of claim 6 wherein each of the plurality of flexible fastener loops in the first array is aligned directly across from a corresponding one of the plurality of flexible fastener loops in the second array.

9. The watercraft of claim 1 wherein the plurality of backing material patches are affixed to the elongated strip of material.

10. The watercraft of claim 1 wherein the plurality of backing material patches are affixed to the elongated strip of material using an adhesive.

11. The watercraft of claim 1 wherein each of the plurality of flexible fastener loops is a webbing loop.

12. The watercraft of claim 1 wherein each of the plurality of flexible fastener loops in the first array is aligned directly across from a corresponding one of the plurality of flexible fastener loops in the second array.

13. A watercraft, comprising:

an inner bottom surface, a bow end, a stern end, a first inner side surface, and a second inner side surface;

a first array of a plurality of flexible fastener loop assemblies provided along the first inner side surface along a first reference line extending between the bow end and the stern end;

a second array of a plurality of flexible fastener loop assemblies provided along the second inner side surface along a second reference line extending between the bow end and the stern end;

wherein each of the first and second arrays comprise:

a plurality of flexible fastener loops;

a plurality of backing material patches to which a back end of a corresponding one of each of the plurality of flexible fastener loops is affixed; and a plurality of elongated strips of material sized to cover a corresponding one of the plurality of backing material patches, each said elongated strip of material having first and second slit openings, wherein the plurality of backing material patches is provided between the first or second inner side surface and the elongated strip of material, wherein first and second front looped ends of each of the plurality of flexible fastener loops extend through corresponding first and second slits in a corresponding one of the plurality of elongated strips of material and the back end of each of the plurality of flexible fastener loops is sandwiched between the corresponding one of the plurality of elongated strips of material and a corresponding one of the plurality of backing material patches, and wherein each pair of corresponding ones of the plurality of the elongated strips of material and the plurality of backing material patches are affixed to the first or second inner side surfaces.

14. A system for attaching items to a personal watercraft or a portable dock having an outer surface and opposing sides, said system comprising:

first and second arrays of a plurality of flexible fastener loops provided on the opposing sides of the personal watercraft or portable dock outer surface;

a plurality of G-Hook connectors configured to be securely received and connected to corresponding ones of the plurality of flexible fasteners loops; and a plurality of webbing straps configured to be connected to one or more of the plurality of G-Hook connectors, wherein each one of the plurality of flexible fastener loops includes:

backing material to which each of the plurality of flexible fastener loops is affixed at a back end; and an elongated strip of material sized to extend the length of the first or second array, said elongated strip of material having an array of slit openings, wherein the backing material is provided between the personal watercraft or portable dock outer surface and the elongated strip of material, wherein the front looped end of each of the plurality of flexible fastener loops extends through a corresponding one of the slits in the array of slit openings and the back end of each of the plurality of flexible fastener loops is sandwiched between the elongated strip of material and the backing material, and wherein the elongated strip of material and backing material are affixed to the outer surface.

15. The system of claim 14 wherein each of the plurality of flexible fastener loops is affixed at the back end to the backing material by sewing threads.

16. The system of claim 14 wherein the backing material is affixed to the elongated strip of material using an adhesive.

17. The system of claim 14 wherein each of the plurality of flexible fastener loops is a webbing loop.

18. The system of claim 14 wherein each of the plurality of flexible fastener loops in the first array is aligned directly across from a corresponding one of the plurality of flexible fastener loops in the second array.

19. The system of claim 14 wherein the backing material and the elongated strip of material are comprised of PVC or TPU.

20. The system of claim 14 wherein each of the plurality of G-Hook connectors comprises:

an opening communicating with a central slot configured to receive webbing material, said opening permitting the webbing material to be slid into and out of the central slot, and said opening including an angled entry surface extending from an end of the opening distal from the central slot to about a midpoint of the central slot.

21. A watercraft, comprising:

an outer surface including a top surface, a first side surface and a second side surface, wherein the first side surface and the second side surface are on opposing sides of the top surface, and wherein the top surface and the first side surface intersect at a first gunwale portion and the top surface and the second side surface intersect at a second gunwale portion;

a first array of a plurality of flexible fastener loop assemblies provided at or near the top surface at or near the first gunwale portion;

a second array of a plurality of flexible fastener loop assemblies provided at or near the top surface at or near the second gunwale portion;

wherein each of the first and second arrays comprise:

a plurality of flexible fastener loops; and an elongated strip of material sized to extend the length of the first or second array, said elongated strip of material having an array of slit openings, wherein a front looped end of each of the plurality of flexible fastener loops extends through a corresponding one of the slits in the array of slit openings, and wherein the elongated strip of material is affixed to the outer surface at or near the top surface at or near the first gunwale portion or the second gunwale portion.

* * * * *